US006854904B2

(12) United States Patent
Oshino et al.

(10) Patent No.: US 6,854,904 B2
(45) Date of Patent: Feb. 15, 2005

(54) MARK PRINTING/VERIFYING DEVICE, MARK PRINTING/VERIFYING METHOD AND MARK PRINTING CONTROL METHOD

(75) Inventors: Genzi Oshino, Miyagi (JP); Atsushi Okamura, Miyagi (JP)

(73) Assignee: Tohoku Ricoh Co., Ltd., Miyagi (JP)

( * ) Notice: Subject to any disclaimer, the term of this patent is extended or adjusted under 35 U.S.C. 154(b) by 0 days.

(21) Appl. No.: 10/665,212

(22) Filed: Sep. 22, 2003

(65) Prior Publication Data

US 2004/0057768 A1 Mar. 25, 2004

(30) Foreign Application Priority Data

Sep. 20, 2002 (JP) ..... 2002-276416
Aug. 18, 2003 (JP) ..... 2003-207748

(51) Int. Cl.[7] ..... B41J 2/00
(52) U.S. Cl. ..... 400/103; 400/107
(58) Field of Search ..... 400/103–107, 400/74; 347/179, 188, 211; 235/462.01

(56) References Cited

U.S. PATENT DOCUMENTS 4,699,531 A 10/1987 Ulinski, Sr. et al.
5,729,001 A * 3/1998 Spitz ..... 235/462.01
6,244,764 B1 * 6/2001 Lei et al. ..... 400/103

FOREIGN PATENT DOCUMENTS

JP 5-4912 1/1993
JP 8-25321 3/1996
JP 10000838 A * 1/1998 ..... B41J/29/46
JP 11185014 A * 7/1999 ..... G06T/1/00

* cited by examiner

*Primary Examiner*—Minh Chau
(74) *Attorney, Agent, or Firm*—Westerman, Hattori, Daniels & Adrian, LLP

(57) ABSTRACT

A printing/verifying direction section in a control section directs a thermal head controller and a sheet conveying motor controller to do printing in accordance with a detection result by a sheet position detection sensor, so as to print image data in a printing image storage section on a sheet (label) by a thermal head. Further, based on printing position data from a printing data storage section, the printing/verifying direction section directs a verification section controller to operate a scanner controller so as to permit a scanner to read an image of a printed mark. The verification section controller compares the read image with printing data in the printing data storage section to judge whether the image is good or no good. When it is no good, the mark is returned to a printing position by the thermal head by a direction of a printing/verifying controller, so that the thermal head prints an overwriting image in an overwriting image storage section on the mark.

20 Claims, 13 Drawing Sheets

LABEL 1

LABEL 2

LABEL 3

MARK PRINTING/VERIFYING DEVICE, MARK PRINTING/VERIFYING METHOD AND MARK PRINTING CONTROL METHOD

BACKGROUND OF THE INVENTION

1. Field of the Invention

The present invention relates to a mark printing/verifying device which prints a mark such as a barcode, then scans and reads the mark, and verifies the printing result, and a mark printing/verifying method and a mark printing control method thereof.

2. Description of the Related Art

Recently, automatic recognition systems using marks such as barcodes are widely used in various fields. The barcode, in which information is encoded and indicated in an array of spaces and bars, is printed directly on an item or printed on a sheet such as a tag or label attached to an item. The information included in the printed barcode is read using a dedicated optical information reading device (a barcode reader).

On the other hand, in a mark printing device (a barcode printer), a barcode is transferred to a sheet by selectively allowing a thermal head to generate heat based on image data of a barcode to be printed, bringing a thermal transfer ribbon and a sheet overlaid one upon the other into pressure contact therewith, and melting ink contained in the thermal transfer ribbon.

In this event, the optical information reading device cannot correctly read barcodes that are not normally printed by the mark printing device, for example, a barcode having a partial lack caused by a crease in the thermal transfer ribbon or contamination on the thermal head, a barcode having a bar size out of a specified range because of excess or deficiency of heat of the thermal head, and the like. Then, the barcodes having printing defects mixed in normally printed barcodes cause a delay in read work.

Hence, mark printing/verifying devices have been conventionally developed which print barcodes, then scan and read the barcodes by scanners, and verify the printing results (whether the barcodes are normally printed).

For example, as found in JP5-4912B, there is a self correcting-type printing/verifying device which prints a mark such as a barcode on a sheet by a print head such as a thermal head, then scans and reads the mark by a scanner, calculates deviation between dimensions of some portions of the read mark with specified dimensions corresponding thereto, and changes printing drive signals to be applied to the thermal head in a manner to decrease the deviation, thereby adjusting the physical dimensions of the mark. Note that, to prevent a decrease in printing speed, the scanner is driven reciprocating in the lateral direction of the sheet and scans the mark while paper is being conveyed in this device.

Further, as found, for example, in JP8-25321B, there is another mark printing/verifying device which is configured to print a mark on paper, then shift the scanner in a direction of a paper conveying direction during mark scan during which the scanner scans and reads the mark in a direction perpendicular to the paper conveying direction while the paper is being conveyed, so as to be able to scan even a mark having a small length in the paper conveying direction without a decrease in printing/verifying speed (hereafter called "throughput").

However, the conventional mark printing/verifying devices described in the aforementioned two patent documents, in which the scanners scan marks while paper is being conveyed, have problems that they are suitable to scan and verify barcodes (linear codes) made by encoding information in one dimension, but cannot verify two-dimensional codes having a high density of information and an extremely small symbol size (minimally several millimeters square).

It should be noted that the two-dimensional code is a symbol created by encoding information in two dimensions, which has been developed to solve many problems associated with barcodes such as its small amount of information, low density of information, large symbol, incapability of using kana and kanji (Japanese letters and Chinese letters), impossibility to read when it becomes dirt, limited in read direction, and so on, and spread rapidly in recent years to be coexistent with barcodes.

Further, the two-dimensional codes include a stack-type two-dimensional code (also referred to as a two-dimensional barcode) such as PDF417 in a form in which barcodes are stacked and a matrix-type two-dimensional code such as Data Matrix in a form in which black cells in squares of a "go board" (grid), either of which has a low stack height and a small cell size and, as a result, the aforementioned conventional mark printing/verifying devices fail verification and compensation printing based on its result.

Hence, there is a conceivable method of first reading all the image of two-dimensional code using a CCD or laser for mark scan, storing the whole image data once in a memory, then comparing dot information of a printed mark with dot information of a correct mark for verification, and decoding or compensating it.

This case, however, has a problem that a large capacity of memory is required to store the whole read image data, leading to increased cost.

There is an additional problem that it takes time to read and verify the data, resulting in a lowered throughput.

SUMMARY OF THE INVENTION

The invention is made to solve these problems, and its object is to make a mark printing/verifying device capable of printing and verifying even a mark such as a two-dimensional code, and prevent an increase in cost and a decrease in throughput of the mark printing/verifying device.

A mark printing/verifying device of the invention comprises a thermal head for printing a mark on a sheet, a sheet conveying motor for conveying the sheet, a sheet position detector for detecting a position of the sheet, and an image reader, located downstream from the thermal head in a sheet conveying direction, for reading an image of a printed mark being the mark printed by the thermal head, and a control section for controlling them, and the control section is configured as follows to achieve the above object.

More specifically, the control section comprises a printing image storage means for storing image data indicating a mark in unit of a dot resolution in a main scan direction being a sheet width direction and a sub-scan direction being the sheet conveying direction of the thermal head; a printing data storage means for storing printing position data and printing data of the mark; a thermal head controller for selectively permitting the thermal head to generate heat in accordance with the image data; a sheet conveying motor controller for controlling the sheet conveying motor; and a printing/verifying direction means for directing the thermal head controller and sheet conveying motor controller to do printing in accordance with the sheet position detected by the sheet position detector, and directing the image reader to read the image of the printed mark based on the printing position data.

Further, the control section includes a function of comparing the image of the printed mark read by the image reader with the printing data to judge whether the printed mark is good or no good based on predetermined criteria included in the printing data, and, when the mark is no good, performing invalid printing, which corresponds to imprinting of an invalid mark indicating that the printed mark is no good, on a sheet printed with the mark. The function of performing the invalid printing is a function of, for example, returning the sheet printed with the mark, which has been judged to be no good, to a printing position by the thermal head, and allowing the thermal head to overprint a predetermined image thereon.

Further, it is also adoptable that the control section includes a function of, when performing the invalid printing, conveying the sheet to an arbitrary position, and selectively permitting the heating elements of the thermal head to generate heat in accordance with the image data based on which the mark judged to be no good has been printed so as to reprint the mark thereon.

In this case, for easy visual recognition that the mark is a reprint of the mark on the sheet with the invalid mark imprinted thereon, the reprinting may be performed on a sheet subsequent to a vacant sheet or on a sheet subsequent to a sheet with an explanatory note that it is a reprint.

Besides, a mark printing/verifying method according to the invention by the mark printing/verifying device is characterized by comprising the steps of: dividing the mark in a sub-scan direction to constitute it of a plurality of tiers having a height of integral multiples of a dot resolution in the sub-scan direction of the thermal head; the image reader reading an image a plurality of times at predetermined intervals in the sub-scan direction for the plurality of tiers respectively; the control section judging, every time the image reader reads the image once, whether the read image is good or no good based on a line criterion among the predetermined criteria included in the printing data, such that when the number of judgments to be no good exceeds a predetermined number, the tier is judged to be no good, and when the tier which has been judged to be no good does not satisfy a mark criterion among the predetermined criteria included in the printing data, the mark is judged to be no good.

Further, in the mark printing/verifying method, it is preferable that when the control section judges that the image on a first read by the image reader in a first tier of the printed mark is no good based on the predetermined criteria included in the printing data, a read position by the image reader is corrected in the sub-scan direction by a predetermined amount based on correction judgment information.

Furthermore, it is preferable that the position and a movement amount of the sheet are detected, so that every time the sheet is moved from a reference position by a predetermined amount, the image reader reads the image on the sheet.

A mark printing control method according to the invention, in the mark printing/verifying device, comprises the steps of: the control section comparing a width in the main scan direction of the image of the printed mark read by the image reader with a width in the main scan direction of the printing data; and the thermal head controller operating to lower a heating value of the thermal head when an average of values obtained by subtracting a width dimension in the main scan direction of the printing data from a width dimension in the main scan direction of the image of the printed mark is positive, and raise the heating value when the average is negative.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, embodiments of the invention will be described with reference to the drawings.

Figure 2:
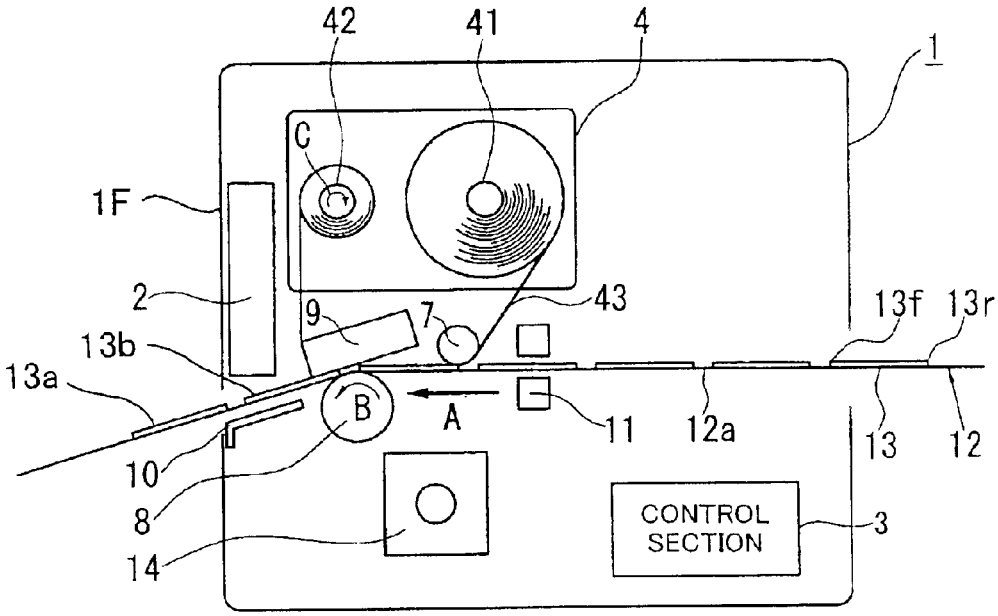
FIG. 2 is a simplified side view showing a principal portion of the barcode printer.

FIG. 2 is a simplified side view of a principal portion of a barcode printer that is an embodiment of a mark printing/verifying device according to the invention.

A barcode printer 1 includes a line-type thermal head 9 having a resolution of 300 dpi composed of heating elements that are arranged side by side in a sheet width direction (hereinafter, also referred to as a "main scan direction") that is a direction perpendicular to a sheet conveying direction (hereinafter, also referred to as a "sub-scan direction") shown by an arrow A in FIG. 2; a platen 8 which holds a later-described sheet 12 which is to be printed and a thermal transfer ribbon 43 with the thermal head 9 and presses them from below, and rotates in a direction shown by an arrow B; and a sheet conveying motor 14 which is connected to the platen 8 via a gear not shown.

Further, a thermal transfer ribbon cassette 4 including a ribbon take-up reel 42 which is connected to the sheet conveying motor 14 via another gear, and a ribbon supply reel 41 around which the thermal transfer ribbon 43 being an ink ribbon made by applying ink to a long thin film is wound, is provided.

It should be noted that a portion of the thermal transfer ribbon 43 is pulled out of the ribbon supply reel 41, guided by a ribbon guide 7 provided upstream from a pressure-contact point of the thermal head 9 and platen 8 in the sheet conveying direction, passes through the pressure-contact point of the thermal head 9 and platen 8, and is thereafter wound around the ribbon take-up reel 42.

The sheet 12 having many labels 13 being release sheets pasted on its front face of a long mount 12*a* at substantially regular intervals in the longitudinal direction is conveyed, passing through between the thermal head 9 and platen 8, in the direction shown by the arrow A. Further, upstream from the pressure-contact point of the thermal head 9 and platen 8 in the conveying direction of the sheet 12, a sheet position detection sensor 11 such as a photointerrupter or the like, which is a sheet position detector for detecting a front end 13*f* and a rear end 13*r* of the label 13, is provided.

On the other hand, downstream from the pressure-contact point of the thermal head 9 and platen 8 in the sheet conveying direction, a guide plate 10 that guides the conveying direction of the sheet 12 to the lower left in FIG. 2, and a scanner 2, which is an image reader for scanning the mark (printed mark) printed on the label 13 by the thermal head 9, are provided. Note that the scanner 2 will be described later in more detail using FIG. 3.

Further, the barcode printer 1 includes a control section 3 for controlling these components. The control section 3 is constituted of a microcomputer or the like, which is composed of a CPU being a central processing unit having various judging and processing functions, a ROM that stores processing programs and fixed data used by the CPU, a RAM being a data memory that stores processed data, an input/output circuit (I/O), and so on. Note that the control section 3 will be described later in more detail using FIG. 1.

Incidentally, in the barcode printer 1, the sheet 12 and thermal transfer ribbon 43 are brought into pressure-contact with the thermal head 9 and platen 8 with the thermal transfer ribbon 43 overlaid on the front face of the sheet 12 on which the label 13 is pasted.

Accordingly, when the sheet conveying motor 14 is driven to rotate the platen 8 in the direction shown by the arrow B (a counter-clockwise direction) via the connected gear, the sheet 12 and label 13 are conveyed in the direction shown by the arrow A (the left direction in FIG. 2), and the thermal transfer ribbon 43 is also pulled out of the ribbon supply reel 41 along the ribbon guide 7 and conveyed in the direction shown by the arrow A.

In this event, among not-shown many heating elements of the thermal head 9, the heating elements corresponding to a portion desired to be printed, that is, the heating elements at positions corresponding to a black portion of the mark are selectively permitted to generate heat. Then, the ink of a portion of the thermal transfer ribbon 43 proximity to the heated heating elements is molten at the pressure-contact point of the thermal head 9 and platen 8, and the ink is transferred to the label 13.

Meanwhile, the ribbon take-up reel 42 is rotated in a direction shown by an arrow C (a clockwise direction) via another gear connected to the sheet conveying motor 14, so that a used portion of the thermal transfer ribbon 43 passed through the pressure-contact point of the thermal head 9 and platen 8 is separated from the sheet 12 which has been printed and wound around the ribbon take-up reel 42 without looseness.

The label 13 on which the mark has been printed by the thermal head 9 is now conveyed along the guide 10 together with the mount 12*a*, and the image of the printed mark is read by the scanner 2.

Figure 3:
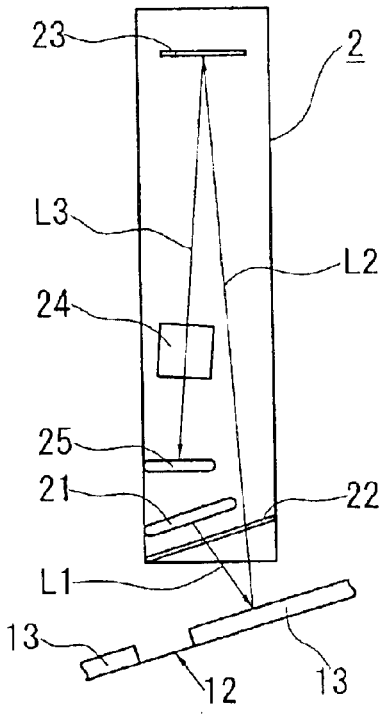
FIG. 3 is a simplified internal configuration diagram showing an enlarged principal portion of a scanner of the barcode printer shown in FIG. 2.

FIG. 3 is an internal configuration diagram showing an enlarged principal portion of the scanner 2 shown in FIG. 2 together with the label 13 and sheet 12.

The scanner 2 is composed of a line-type LED unit 21 in which LEDs are arranged side by side in the main scan direction, a dustproof glass 22, a mirror 23, a lens 24, and a line-type CCD unit 25 in which CCDs are arranged side by side in the main scan direction.

The LED unit 21 irradiates the label 13 on the sheet 12 with light L1. Reflected light L2 reflected by the label 13 passes through the dustproof glass 22, reaches the mirror 23, and is reflected by the mirror 23. Reflected light L3 is image-formed by the lens 24 and received by the CCD unit 25. In this event, since the reflectance on the front face of the label 13 varies in accordance with the printed mark on the label 13, the image of the printed mark on the label 13 is image-formed on the CCD unit 25 and read such that a portion to which the ink of the thermal transfer ribbon 43 is transferred by the heating elements of the thermal head 9 selectively permitted to generate heat as black and a portion to which the ink of the thermal transfer ribbon 43 is not transferred at a non-heated portion of the thermal head 9 as white. Hereinafter, a portion to be transferred of a mark is called "black data" and a portion not to be transferred is called "white data" for explanation.

Figure 1:
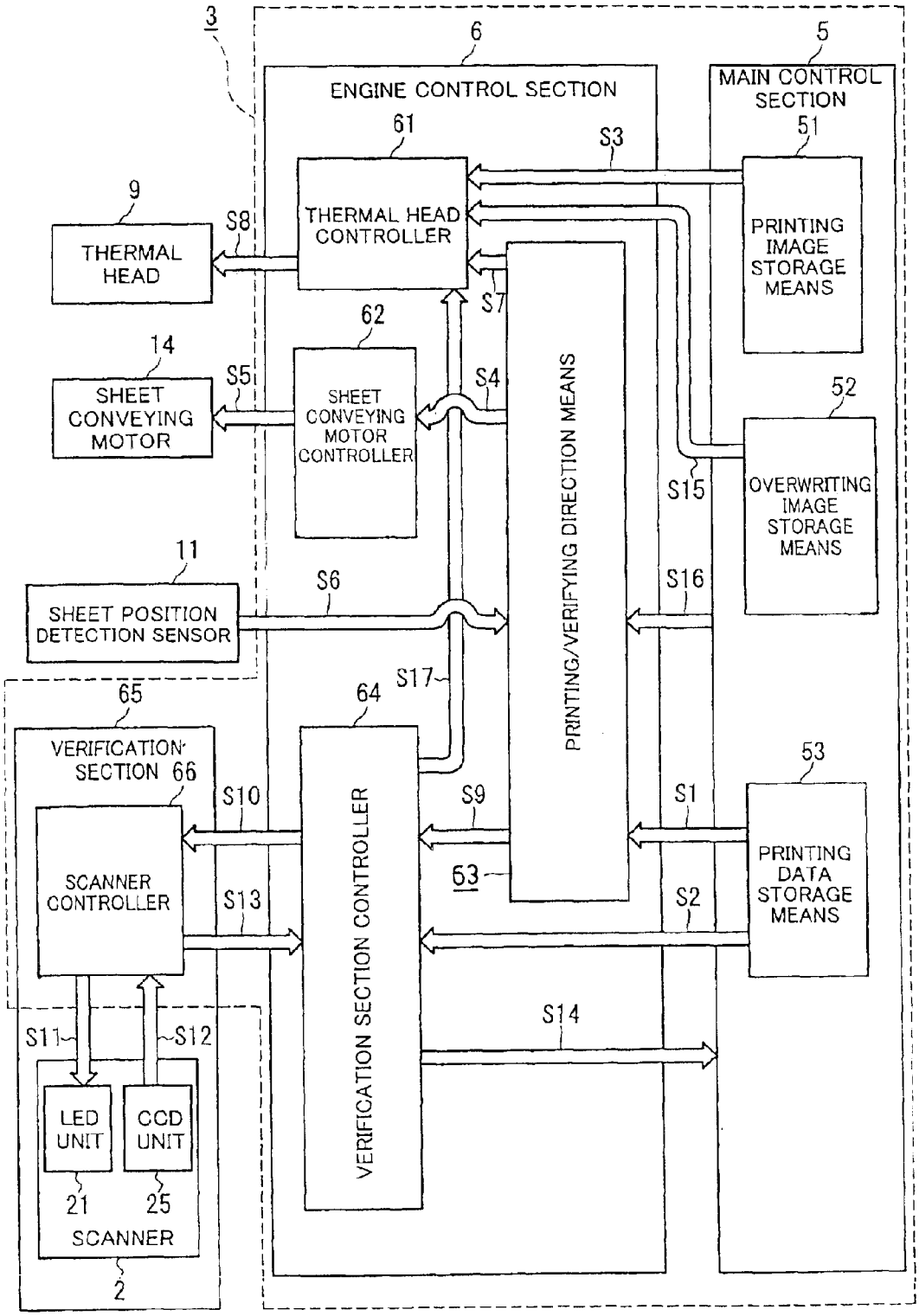
FIG. 1 is a block diagram showing the function of a control section of a barcode printer that is an embodiment of a mark printing/verifying device according to the invention.

Next, the control section 3 of the barcode printer 1 is described. FIG. 1 is a block diagram showing the function of the control section 3.

The control section 3 that is a portion shown surrounded by a broken line in FIG. 1 is composed of a main control section 5, an engine control section 6, and a scanner controller 66 of a verification section 65, and thus constituted of the microcomputer, various drive circuits and so on as described above.

The main control section 5 has a printing image storage means 51 that stores image data indicating a mark in unit of a dot resolution in the main scan direction and sub-scan direction of the thermal head 9; a printing data storage means 53 that stores printing position data and printing data of the mark; and an overwriting image storage means 52 that stores overwriting image data. While these employ RAMs being data memories, the overwriting image storage means 52 may employ a ROM.

Besides, the scanner controller 66, constituting the verification section 65 together with the scanner 2 shown in FIG. 2, controls drive of the scanner 2.

The engine control section 6 has a thermal head controller 61 including a thermal head drive circuit that selectively permits the heating elements of the thermal head 9 to generate heat in accordance with the image data stored in the printing image storage means 51; a sheet conveying motor controller 62 that controls the sheet conveying motor 14; a verification section controller 64 that controls the verification section 65; and a printing/verifying direction means 63 that directs the thermal head controller 61 and sheet conveying motor controller 62 to do printing in accordance with the sheet position detected by the sheet position detection sensor 11 being the sheet position detector, and directs the verification section controller 64 to read an image based on the printing position data stored in the printing data storage means 53.

Subsequently, the function of each of the above-described means constituting the control section 3 is described in detail in order of printing and verification operations performed in the barcode printer 1.

When the barcode printer 1 shown in FIG. 2 prints a mark on the label 13 on the sheet 12, the printing image storage means 51 of the main control section 5 shown in FIG. 1 first stores image data of a mark being a target (desired to be printed), and the printing data storage means 53 stores printing data and printing position data of the mark.

The printing data and printing position data are data to be used when the verification section controller 64 of the engine control section 6 which will be described later reads the image of a printed mark and judges whether it is good or no good. Specifically, the printing data represents data on the width dimension of black data continuing in the main scan direction of the mark and on the manner of array of the back data and white data, and the printing position data represents data on the position where the mark is to be printed.

Then, prior to printing, the printing position data is passed to the printing/verifying direction means 63 of the engine control section 6 from the printing data storage means 53 (shown by an arrow S1), and the printing data is passed to the verification section controller 64 (shown by an arrow S2).

Further, the image data is passed, by every row of dot data (hereafter called "one dot line") in which dots are arranged side by side in the main scan direction, to the thermal head controller 61 from the printing image storage means 51 (shown by an arrow S3).

Thereafter, the printing/verifying direction means 63 directs the sheet conveying motor controller 62 (shown by an arrow S4) to drive the sheet conveying motor 14 (shown by an arrow S5). This rotates the platen 8 in the direction shown by the arrow B in FIG. 2, so that the sheet 12 and label 13 are conveyed in the direction shown by the arrow A.

In this event, the sheet position detection sensor 11 detects the front end 13*f* and the rear end 13*r* of the label 13 on the sheet 12 and send the detection result to the printing/verifying direction means 63 (shown by an arrow S6).

The printing/verifying direction means 63 determines a printing start position and a printing end position of the label 13 based on the detection result from the sheet position detection sensor 11 and the aforementioned printing position data, and meanwhile directs the sheet conveying motor controller 62 to drive the sheet conveying motor 14 so as to convey the front end 13*f* of the label 13 to the pressure-contact point of the thermal head 9 and platen 8 that is the printing position by the thermal head 9.

When the front end 13*f* of the label 13 is conveyed to the printing position by the thermal head 9, the printing/verifying direction means 63 directs the thermal head controller 61 (shown by an arrow S7) to selectively permit a number of heating elements of the thermal head 9 to generate heat (shown by an arrow S8), and simultaneously directs the sheet conveying motor controller 62 to drive the sheet conveying motor 14. This causes a mark to be printed on the label 13 on the sheet 12.

Further, immediately before the printing start position of the label 13 determined based on the printing position data passes below the scanner 2, the printing/verifying direction means 63 directs the verification section controller 64 (shown by an arrow S9) to operate the scanner controller 66 of the verification section 65 (shown by an arrow S10), thereby turning on the LED unit 21 of the scanner 2 (shown by an arrow S11) for irradiation of the printed mark on the label 13 with the light L1 as shown in FIG. 3.

The scanner controller 66 varies the duty of ON/OFF of current (the pulse-width ratio) conducted to the LED unit 21 to control the light amount of the light L1 every time the scanner 2 scans a row of dots arranged side by side in the main scan direction (one dot line) of the printed mark (hereafter referred to as "scan line").

With, as a reference, the amount of reflected light, which is reflected by a portion outside the printing range (for example, a margin portion other than the portion from the printing start position to the printing end position of the label 13) in the main scan direction, of the reflected light L3 by the label 13 which is read into the CCD unit 25 of the scanner 2, the light amount of the light L1 is controlled so that the contrast between the light amount and the reflected light by the portion of the aforementioned black data falls within a predetermined range which is determined in accordance with the material of the label 13, the kind of the mark, the performance of the scanner 2, and so on.

Figure 19:
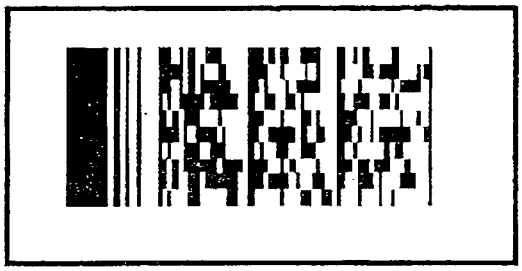
FIG. 19 to FIG. 21 are plan views respectively showing different examples of labels (labels 1, 2 and 3) created.
Figure 20:
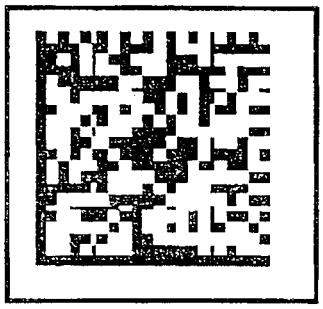
Figure 21:
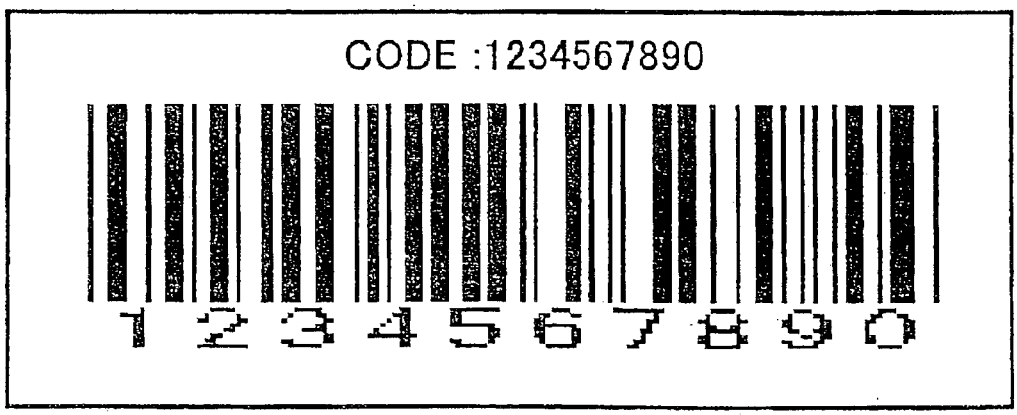

It should be noted that the light amount of the light L1 shown in FIG. 3 is controlled for every scan line, but if printing is performed in a combination of labels whose materials are different by the sheet (page) such as labels 1 to 3 shown in FIG. 19 to FIG. 21, the light amounts of the light L3 (the amounts of reflected light) by the labels may be different.

Figure 22:
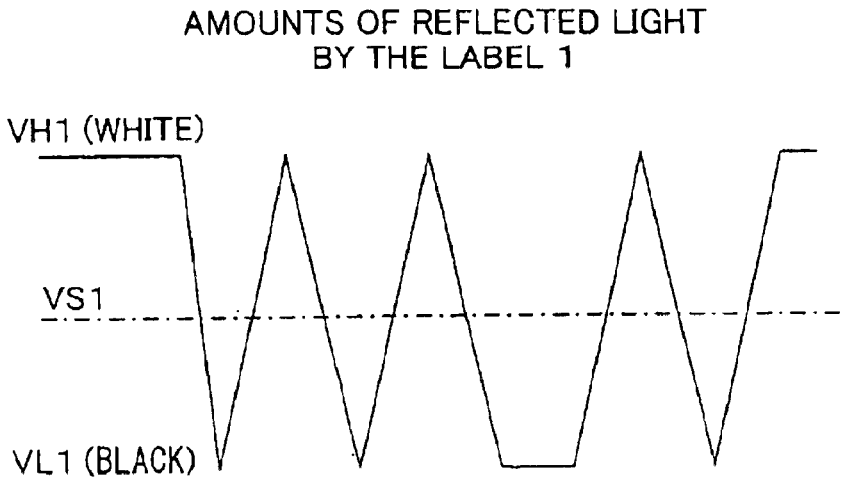
FIG. 22 is a diagram schematically showing the level of each amount of reflected light by the label 1 shown in FIG. 19.
Figure 23:
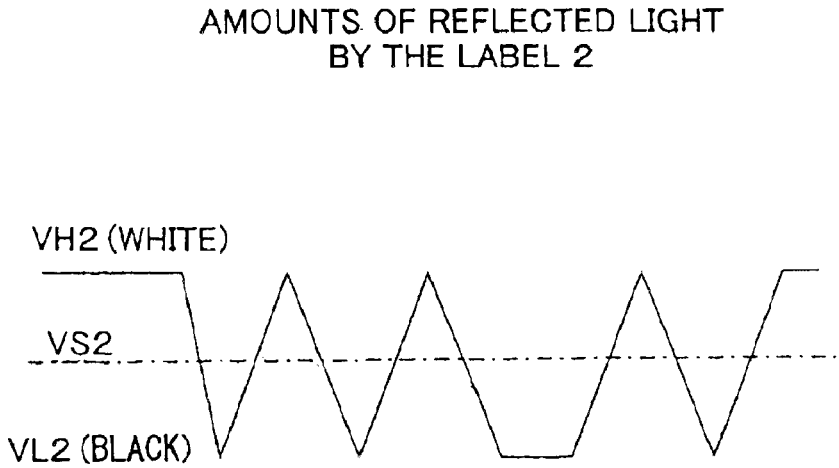
FIG. 23 is a diagram schematically showing the level of each amount of reflected light by the label 2 shown in FIG. 20.

FIG. 22 and FIG. 23 are diagrams schematically showing the levels of the amounts of reflected light by the label 1 shown in FIG. 19 and the label 2 shown in FIG. 20. By setting a threshold level VS midway between a reflected light amount VH at a white level and a reflected light amount VL at a black level, the width of a barcode can be accurately measured. If the amounts of reflected light by the labels are different, the widths of the barcodes on the labels can be accurately measured by setting a threshold level VS1 midway between a reflected light amount VH1 at a white level and a reflected light amount VL1 at a black level of the label 1 , and by setting a threshold level VS2 midway between a reflected light amount VH2 at a white level and a reflected light amount VL2 at a black level of the label 2.

Besides, if the mount 12*a* of the sheet 12 and the label 13 shown in FIG. 2 are transparent, the light amount of the light L1 is similarly controlled with as a reference the light amount of reflected light from a not-shown reflecting plate that is mounted on a portion located below the scanner 2 of a not-shown conveying path of the barcode printer 1 through which the sheet 12 passes.

The image of the printed mark formed on the CCD unit 25 shown in FIG. 1 and FIG. 3 is read by every one scan line in the main scan direction, and its image data is sent to the scanner controller 66 in FIG. 1 (shown by an arrow S12) and further sent to the verification section controller 64 (shown by an arrow S13).

The verification section controller 64 compares the image data with the printing data passed from the printing data storage means 53, and first verifies whether the array of black data and white data (hereinafter simply called a "data array") of the image matches with the array of the data included in the printing data. Then, if the data arrays do not match with each other, the verification section controller 64 judges that the scan line is no good (NG).

When the data arrays match with each other, the verification section controller 64 next compares the width dimension of black data continuing in the main scan direction of the image of the printed mark with the width dimension of black data of the printing data corresponding thereto for plural pieces of black data. When the difference therebetween (the difference between the width dimension of the black data of the image of the printed mark and the width dimension of the black data of the printing data) exceeds an allowable range of black data width dimension contained in the printing data passed from the printing data storage means 53, the verification section controller 64 judges that the scan line is no good (NG).

When the verification section controller 64 judges that a scan line is no good (NG) as described above, the verification section controller 64 notifies the judgment of NG to the main control section 5 (shown by an arrow S14).

When notified of the judgment of NG, the main control section 5 passes the overwriting image data stored in the overwriting image storage means 52 to the thermal head controller 61 (shown by an arrow S15).

Further, the main control section 5 sends a signal to the printing/verifying direction means 63 (shown by an arrow S16), whereby the printing/verifying direction means 63 directs the sheet conveying motor controller 62 (shown by the arrow S4) to temporarily stop the sheet conveying motor 14 and thereafter drive the sheet conveying motor 14 in the reverse direction so as to reversely rotate the platen 8 (rotate in the direction opposite to the arrow B in FIG. 2), thereby conveying the sheet 12 in the opposite direction (in the right direction in FIG. 2) to return the portion of the scan line of the printed mark on the label 13 which has been judged to be NG to the printing position by the thermal head 9.

Then, the printing/verifying direction means 63 directs, similarly to the above-described case of printing the mark, the thermal head controller 61 (shown by the arrow S7) to selectively permit the heating elements of the thermal head 9 to generate heat in accordance with the overwriting image data (shown by the arrow S8), and simultaneously directs the sheet conveying motor controller 62 (S4) to drive the sheet conveying motor 14 (shown by the arrow S5), thereby normally rotating the platen 8 (in the direction shown by the arrow B in FIG. 2) to permit the thermal head 9 to print an overwriting image on the label 13.

The overwriting image is printed on the almost entire portion which has been printed until the printed mark on the label 13 is judged to be NG. The printing of this overwriting image corresponds to imprinting of an invalid mark which indicates that the printed mark is no good.

It should be noted that the invalid printing on the sheet with a printed mark which has been judged to be NG may be performed by imprinting an invalid mark through use of means other than the thermal head.

Then, the control section 3 permits the sheet conveying motor controller 62 to drive the sheet conveying motor 14, thereby conveying the sheet 12 to an arbitrary position, and selectively permitting the heating elements of the thermal head 9 to generate heat in accordance with the image data based on which the mark judged to be no good has been printed, and to reprint the mark.

For example, for easy visual recognition that the mark is a reprint of the mark on the sheet with the invalid mark imprinted thereon, the reprinting may be performed on a sheet subsequent to a vacant sheet or on a sheet subsequent to a sheet with an explanatory note that it is a reprint.

Figure 4:
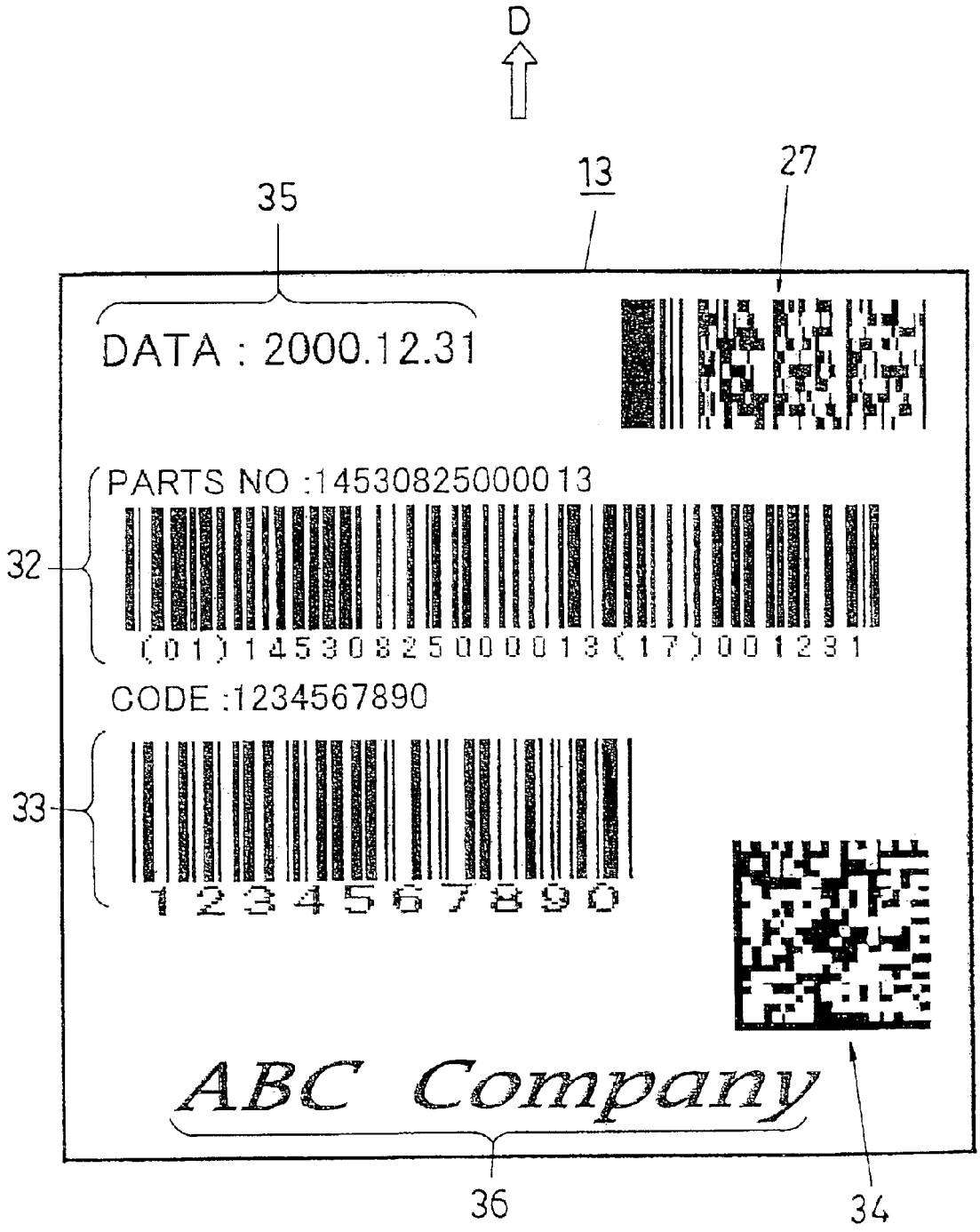
FIG. 4 is a plan view showing an example of a label on which a mark is printed by the barcode printer shown in FIG. 1 to FIG. 3.

FIG. 4 is a plan view showing an example of a label on which marks are printed by the barcode printer according to the invention.

On the label 13 shown in FIG. 4, a mark 27 in PDF417 that is a stack-type two dimensional code, a mark 32 in UCC/EAN-128 that is a continuous-type bar code, a mark 33 in Code 11 that is a discrete-type bar code, and a mark 34 in data matrix (also referred to as a data code) that is a matrix-type two dimensional code, are printed in order from the upper side in the sub-scan direction shown by the arrow D, together with alphanumeric characters 35 and 36 which represent date and company name.

Figure 5:
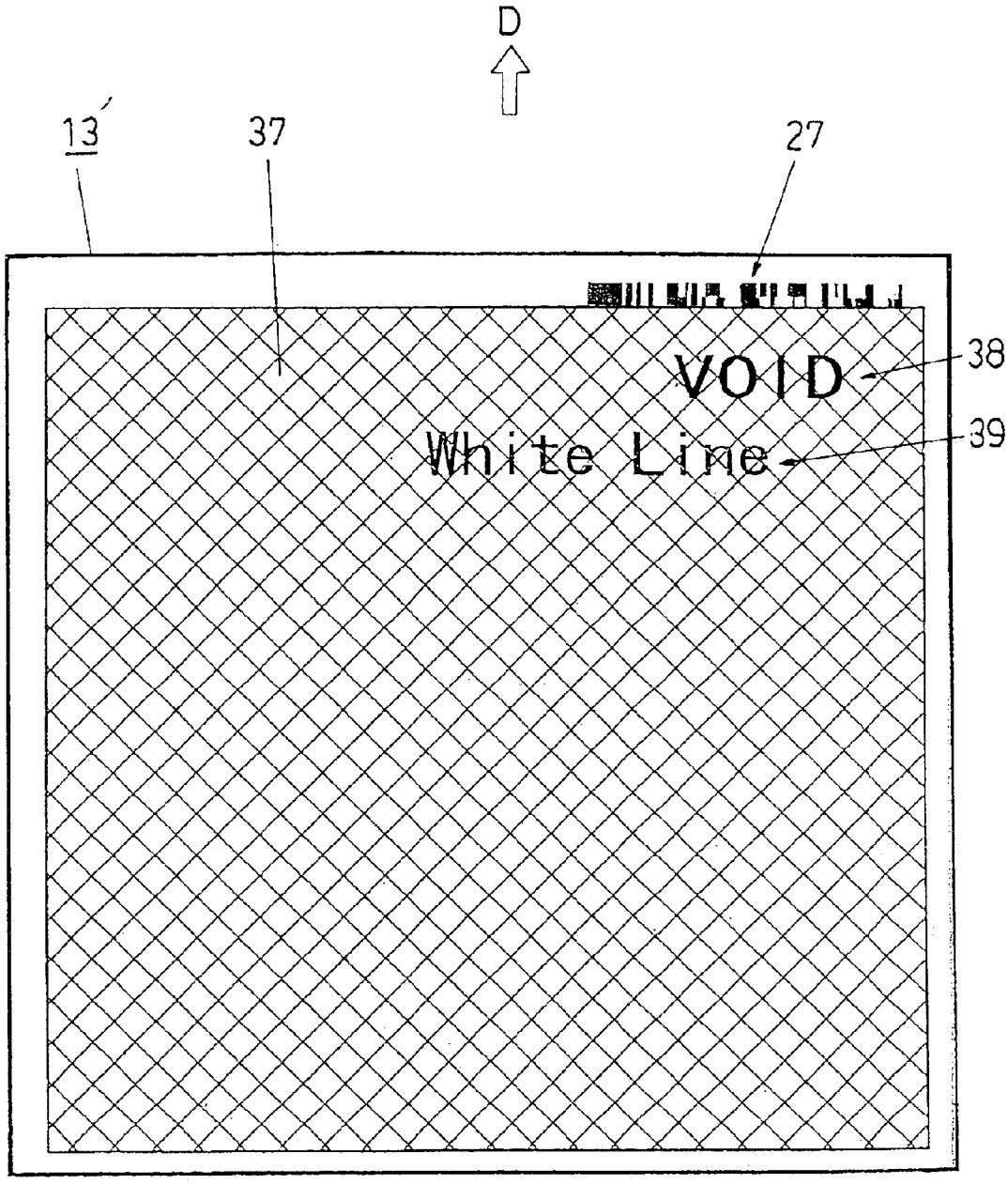
FIG. 5 is a plan view showing an example in which an overwriting image is overprinted on the label shown in FIG. 4.

FIG. 5 is a plan view showing an example of the label shown in FIG. 4 with an overwriting image printed thereon through invalid printing.

On a label 13' in FIG. 5, a shading image 37 is printed on the almost entire surface as the invalid mark which indicates the label 13 shown in FIG. 4 is no good. Further, a message 38 ("VOID" in FIG. 5) indicating that this mark is invalid and a message 39 ("White Line" indicating that there is a white line-shaped printing lack in FIG. 5) indicating the defective contents of the mark, are overwritten. These overwriting images are stored in the overwriting image storage means 52 of the main control section 5 in advance as described above.

As described above, according to the invention, the verification section controller compares a read image with the printing data to judge whether the printed mark is good or no good every time the scanner reads a line of dots (one dot line) of the mark arranged side by side in the main scan direction of the mark, so that two dimensional codes having a high density of information and an extremely small symbol size can be verified without use of a large capacity of memory. In addition, since the image of the printed mark can be read and verified without interruption of printing, the throughput (the number of printing marks per unit time) is not lowered.

Furthermore, when the printed mark is verified and judged to be NG, invalid printing is performed on the printed mark by printing an overwriting image indicating that the mark is no good or the like, thus making it possible to prevent the mark having a printing lack from being mixed in normal marks.

It should be noted that any overwriting images are acceptable as long as they tell that the label overwritten is no good (invalid). Therefore, the overwriting image is not limited to the shading but, for example, a cross (X) mark, painting out, and stipple are also acceptable.

Besides, overwriting a message indicative of invalidity provides an advantage that an operator easily judges the label invalid, and overwriting a message indicating defective contents provides an advantage that it helps to defect analysis in managing the barcode printer. These messages, however, are not essential for the invention, and may be omitted.

Furthermore, printing an overwriting image on the almost entire surface of the printed mark on the label provides an advantage that an operator can recognize whether the label is good or no good at a glance. The overwriting image, however, is not necessarily printed on the almost entire surface of the printed mark on the label but may be overprinted on a part of the mark as an invalid mark.

In other words, the overwriting image as the invalid mark may be changed in contents and size as necessary in accordance with the kind and usage of the label. Further, the overwriting image can be easily changed only by changing the overwriting image data to be stored in the overwriting image storage means 52.

Next, a mark printing/verifying method of the barcode printer 1 is described.

Figure 6:
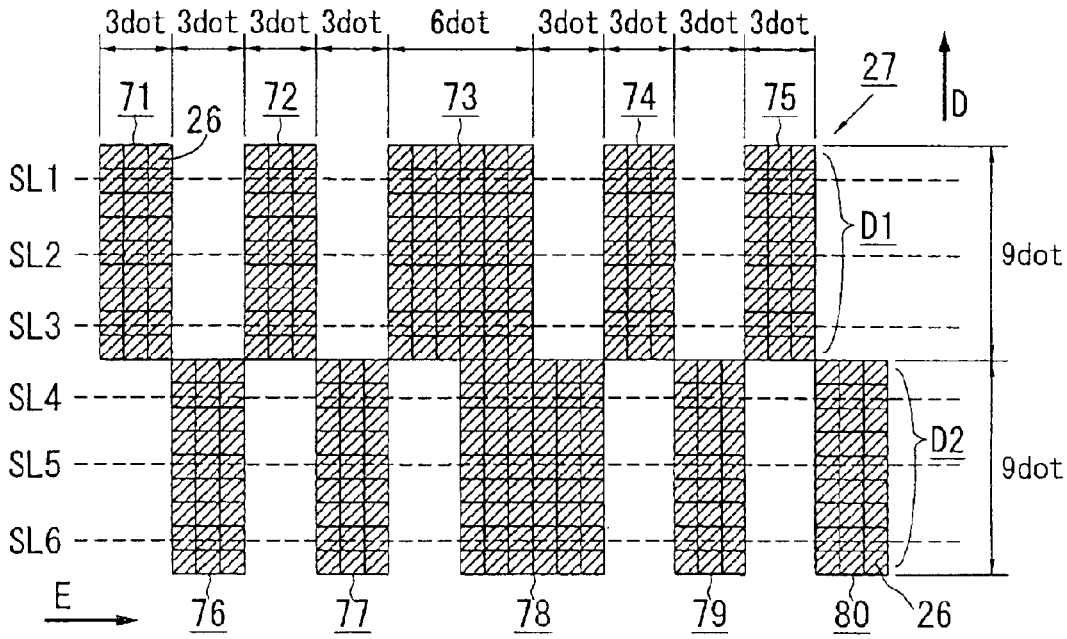
FIG. 6 is an enlarged schematic diagram showing a portion of the mark on the label shown in FIG. 4 with its black data indicated by a small square for every one dot.

FIG. 6 is an enlarged schematic diagram showing a portion of the mark 27 on the label 13 shown in FIG. 4 with its black data (shown by drawing diagonal lines) indicated by a small square for every one dot. It should be noted that a dot 26 is a portion where the thermal head 9 shown in FIG. 1 selectively allows the heating elements to generate heat for every pixel size of 300 dpi, so that the ink of the thermal transfer ribbon 43 is transferred to the label.

The mark 27 in FIG. 6 is composed of a plurality of tiers (a first tier D1 and a second tier D2) having a height of integral multiples of the dot resolution in the sub-scan direction (a direction shown by an arrow D) of the thermal head 9. The first tier D1 is composed of black data 71 in a rectangle formed by 3 dots continuing in a direction shown by an arrow E being the main scan direction by 9 dots continuing in the direction shown by the arrow D being the sub-scan direction (hereinafter, referred to only as "3 dots by 9 dots"), 3 dots by 9 dots white data, 3 dots by 9 dots black data 72, 3 dots by 9 dots white data, 6 dots by 9 dots black data 73, 3 dots by 9 dots white data, 3 dots by 9 dots black data 74, 3 dots by 9 dots white data, 3 dots by 9 dots black data 75, 3 dots by 9 dots white data, . . . from the left-hand side.

Similarly, the second tier D2 is composed of 3 dots by 9 dots white data, 3 dots by 9 dots black data 76, 3 dots by 9 dots white data, 3 dots by 9 dots black data 77, 3 dots by 9 dots white data, 6 dots by 9 dots black data 78, 3 dots by 9 dots white data, 3 dots by 9 dots black data 79, 3 dots by 9 dots white data, 3 dots by 9 dots black data 80, . . . from the left-hand side.

In short, each of the first tier D1 and second tier D2 has nine lines of dots (nine dot lines) arranged side by side in the main scan direction.

On the other hand, in the control section 3 shown in FIG. 1, the printing/verifying direction means 63 directs, via the verification section controller 64, the scanner control section 65 to allow the scanner 2 to read the image a plurality of times at predetermined intervals in the sub-scan direction for the first tier D1 and second tier D2 respectively. In other words, the scanner 2 reads a plurality of arbitrary lines among the nine dot lines of every tier.

The scan lines read by the scanner 2 are shown by broken lines SL1 to SL6. In FIG. 6, the scanner 2 reads every three dot lines three times for each of the first tier D1 and second tier D2.

The scan lines SL1 to SL6, however, needs to bypass the boundary between tiers to reliably read the image which is transferred in pixel size of the thermal head 9.

Therefore, the scan line SL1, which is the san line for a first read in the first tier D1 of the mark 27, is set at a position spaced from (a position lower than in FIG. 6) the head position in the sub-scan direction of the first tier D1 by about 1.5 dots. Further, the scan line SL2, which is the scan line for a second read, is set at a position further spaced from (a position lower than in FIG. 6) the position of the scan line SL1 by about 3 dots. Subsequently, the positions of the scan lines SL3 to SL6 are set respectively about every 3 dots.

This setting allows the scanner 2 to reliably read the printed image three times for each of the first tier D1 and second tier D2 so that scan data that is the reading result can be obtained.

It should be noted that the verification section controller 64 of the control section 3 shown in FIG. 1 judges whether the scan data is good or no good every one scan line (every time the scanner 2 reads one dot line of the printed mark one time) based on the printing data. The judgment conducted by the verification section controller 64 is described above in relation to FIG. 1, and therefore the description thereof is omitted here.

The flow of issuing the label 13 in the barcode printer 1 is described here using FIG. 2. Printing is performed on the label 13 on the sheet 12 by selectively driving the heat generating elements of the thermal head 9 and allowing them to generate heat, and then the conveyance of the sheet 12 is stopped with a label 13*a* which has been scanned by the scanner 2 being discharged to a front left side 1F of the barcode printer 1 in FIG. 2. The discharged printed label 13*a* is peeled off from the sheet 12 and attached to an item to be attached not shown.

Thereafter, when a printing direction is sent to the barcode printer 1 to print a label 13*b* subsequent to the label 13*a*, the label 13*b* is returned (in the direction opposite to the arrow A) to the pressure-contact point of the thermal head 9 and platen 8 in FIG. 2. There is a displacement between positions of dot lines and scan lines between the case in which the sheet is conveyed to the direction shown by the arrow A in FIG. 2 and the case in which the sheet is returned to the direction opposite to the arrow A and then conveyed again in the direction shown by the arrow A because of influence of backlash of the coupled gear in the process of transmission of the conveying power from the sheet conveying motor 14 to the platen 8.

Figure 7:
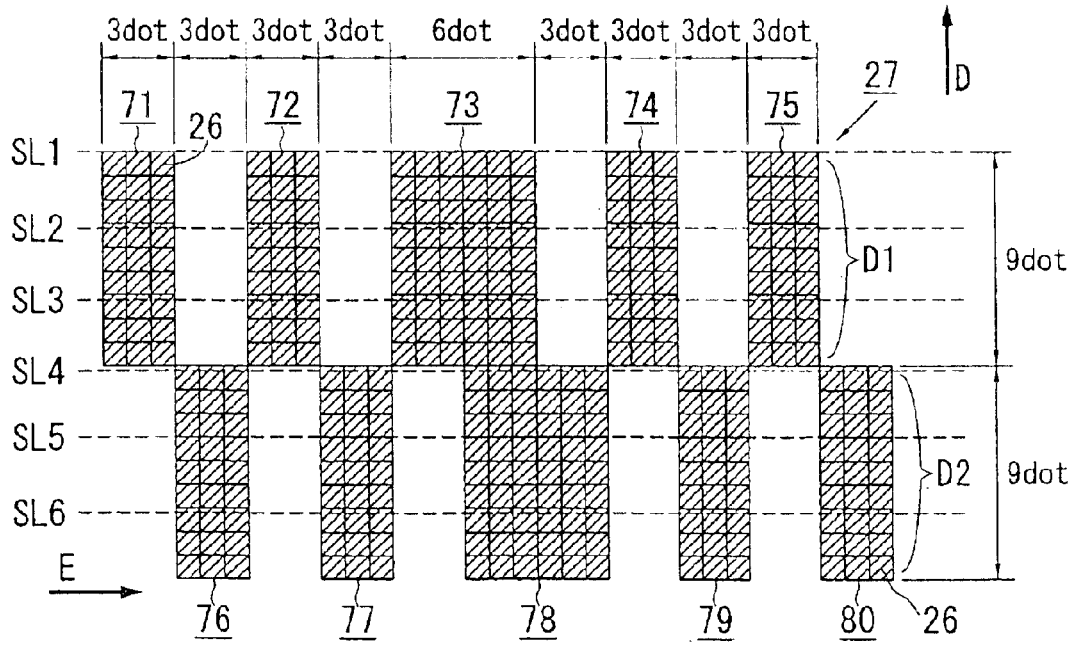
FIG. 7 is a schematic diagram, similar to FIG. 6, showing a case in which scan lines are displaced from dot lines by approximately 1.5 dots in a sub-scan direction.

FIG. 7 is a schematic diagram, similar to FIG. 6, showing a case in which scan lines are displaced from dot lines by approximately 1.5 dots in the sub-scan direction.

In this example, scan lines SL2, SL3, SL5, and SL6 cross the dot lines of the first tier D1 or second tier D2 respectively, while the scan line SL1 crosses the head position in the sub-scan direction of the first tier D1, and the scan line SL4 crosses near the boundary between the first tier D1 and second tier D2. Therefore, it can be only two times to obtain scan data for each of the first tier D1 and second tier D2.

Therefore, in the mark printing/verifying method of the barcode printer 1 according to the invention, when the verification section controller 64 of the control section 3 shown in FIG. 1 judges that the scan data of the scan line SL1 for a first read in the first tier D1 of the printed mark is NG, the verification section controller 64 judges that the dot line and the scan line are displaced from each other, and then corrects the printing position data passed from the printing data storage means 53 based on correction judgment information, thereby correcting the read position by the scanner 2 in the sub-scan direction by a predetermined amount.

For example, in FIG. 7, when the scan line SL1 is NG, SL2 is OK, SL3 is OK, and SL4 is NG, the verification section controller 64 judges, for the scan objects D1 and D2, that the scan lines SL1, SL2, SL3 and SL4 are displaced upward with respect to the scan object D1, and then corrects the positions of the scan lines SL1 to SL6 downward in the sub-scan direction by about 1 dot to 2 dots. Incidentally, after the 1.5 dots correction, they are at positions shown in FIG. 6. Alternatively, when the scan lines SL1, SL2 and SL3 are NG in succession in the scan object D1 because of printing blur or the like, the verification section controller 64 judges that there is no displacement between the dot lines and scan lines, and therefore performs no correction.

Then, the displacements between the positions of the scan lines SL1 to SL6 and the dot lines are eliminated after the scan line subsequent to the displaced scan line or the label in the page subsequent to the label having displacement occurred, thereby allowing the scanner 2 to normally read them.

Figure 8:
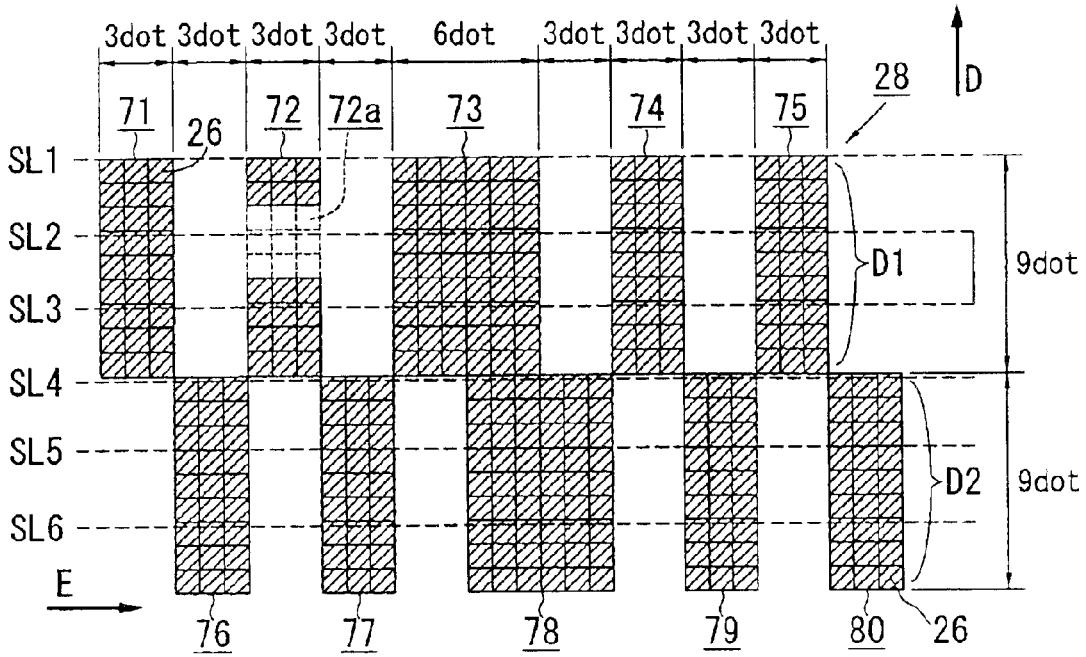
FIG. 8 is a schematic diagram, similar to FIG. 6 and FIG. 7, showing a case in which positions of scan lines are displaced from those of dot lines, and a printed mark to be read by a scanner has a printing defect.

FIG. 8 is a schematic diagram, similar to FIG. 6 and FIG. 7, showing a case in which positions of scan lines are displaced from those of dot lines, and a printed mark to be read by the scanner has a printing defect.

A mark 28 shown in FIG. 8 is almost equal to the mark 27 shown in FIG. 6 and FIG. 7, but has a printing lack 72*a* occupying 3 dots by 3 dots in black data 72 of a first tier D1. For easy recognition of the printing lack 72*a*, every one dot is shown by a small square with a thin broken line in FIG. 8. This printing lack is a kind of printing defect, and a portion where the ink has not been transferred because of attachment of debris such as a paper powder or the like to any of the thermal head 9, label 13, and thermal transfer ribbon 43 shown in FIG. 2.

In the case of the mark 28, the verification section controller 64 shown in FIG. 1 judges that the scan data of the scan line SL2 is NG.

However, such a two dimensional code typically has an error correcting function, and therefore can be decoded despite presence of a partial small-sized printing lack like the printing lack 72*a*. Accordingly, a printed mark even with such a printing lack 72*a* should not be judged as no good.

In other words, even though some scan lines (scan lines SL1, SL2 and SL5 in this case) among a plurality of scan lines read from a printed mark are judged to be NG, the entire printed mark cannot be judged to be no good.

Hence, in the mark printing/verifying method of the barcode printer 1 according to the invention, whether the read image is good or no good is judged every scan line in each tier based on a line criterion (for example, the number or percentage of allowable dots having printing lack) among predetermined criteria included in the printing data, such that when the number of judgments to be no good (NG) (the number of scan lines judged to be no good) exceeds the predetermined number which has been stored in the printing data storage means 53 in advance, the tier is judged to be no good, and when the tier which has been judged to be no good does not satisfy a mark criterion among the predetermined criteria included in the printing data, the printed mark is judged to be no good.

For example, when the number of tiers which have been judged to be no good exceeds the predetermined number, the printed mark is judged to be no good. The mark criterion in this case is that "the number of tiers which have been judged to be no good is smaller than the predetermined number."

Alternatively, when all of the scan lines in a tier have been judged to be NG, the tier is judged to be no good, and when a tier subsequent to the tier which has been judged to be no good is also judged to be no good, the printed mark is judged to be no good. The mark criterion in this case is that "tiers which have been judged to be no good are not in succession." According to this mark printing/verifying method, any of the printed marks shown in FIG. 6, FIG. 7 and FIG. 8 can be judged to be good (acceptable).

Figure 9:
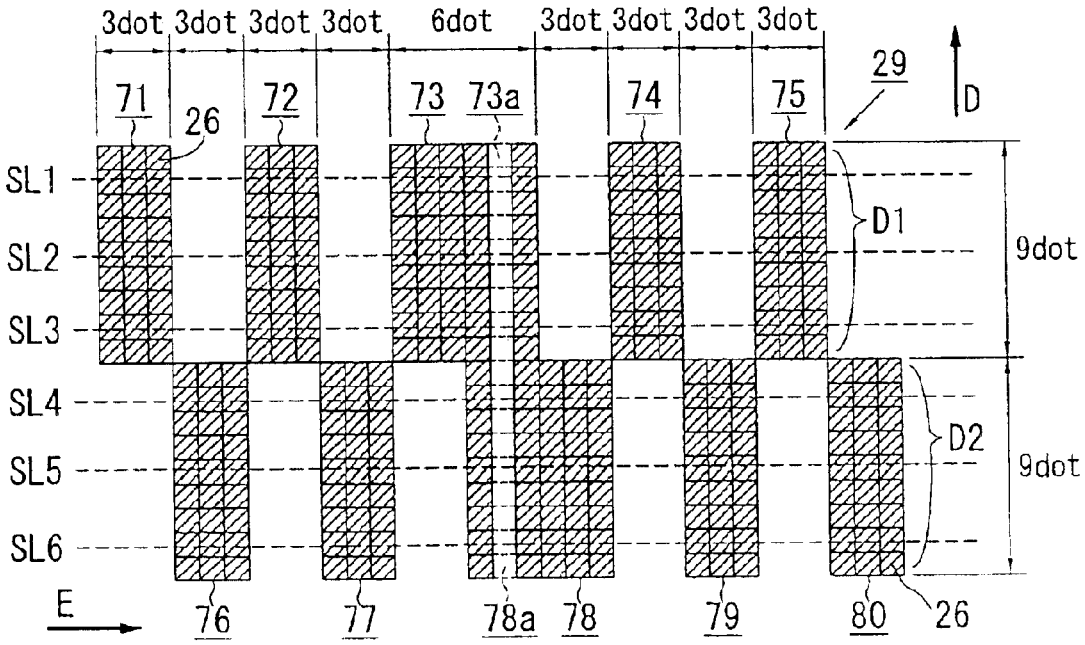
FIG. 9 is a schematic diagram, similar to FIG. 6 to FIG. 8, showing an example of a mark that is judged to be no good by a mark printing/verifying method according to the invention.
Figure 10:
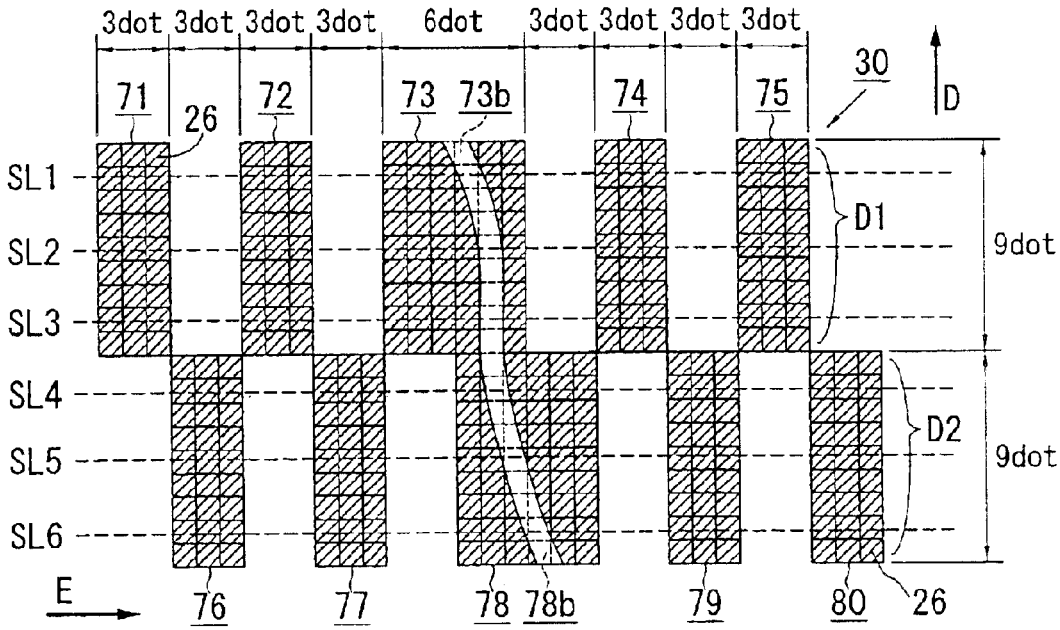
FIG. 10 is a schematic diagram, similar to FIG. 9, showing another example of a mark that is judged to be no good by the mark printing/verifying method according to the invention.

FIG. 9 and FIG. 10 are schematic diagrams, similar to FIG. 6 to FIG. 8, each showing an example of a mark that is judged to be no good by the above-described mark printing/verifying method.

A mark 29 in FIG. 9 is almost equal to the mark 27 shown in FIG. 6 and FIG. 7, but is different therefrom in that there are printing lacks 73*a* and 78*a* extending across the entire length of each tier from black data 73 at a first tier D1 to black data 78 at a second tier D2.

The printing lacks 73*a* and 78*a*, which are a defect (White Line) that 1 dot becomes lacked continuously, in a column form, in the sub-scan direction (the direction shown by an arrow D) to form a white line lying in black data of the printed mark, occur when dirt attaches to a portion of the thermal head 9 and therefore the ink at the portion of the thermal transfer ribbon 43 is not transferred to the label.

A mark 30 in FIG. 10 is an example in which printing lacks 73*b* and 78*b* have occurred in the form of a meandering white line continuously in the sub-scan direction (the direction shown by an arrow D) from black data 73 at a first tier D1 to black data 78 at a second tier D2. The printing lacks 73*b* and 78*b* occur when the ink of the thermal transfer ribbon 43 is not transferred to the label because of a crease or the like therein.

In the cases of the marks 29 and 30, the verification section controller 64 of the control section 3 judges that all of the scan lines SL1 to SL3 are NG to judge the first tier D1 no good, and judges that all of the scan lines SL4 to SL6 are NG to judge the second tier D2 also no good. The verification section controller 64 has judged the tiers in succession no good, thus judging the marks 29 and 30 no good.

It should be noted that the criteria (the line criterion and mark criterion) for judgment of marks are not limited to the aforementioned ones. Changing the printing data stored in the printing data storage means 53 shown in FIG. 1 allows the criteria to be easily changed in accordance with the kind of the mark to be printed.

Besides, the mark printing/verifying method of the barcode printer 1 can verify not only the mark in the stack-type two-dimensional code such as PDF417 shown in FIG. 6 to FIG. 10, but also the matrix-type two-dimensional code such a printed mark 34 in shown in FIG. 4 in a similar manner. Furthermore, the method can similarly verify letters.

Figure 11:
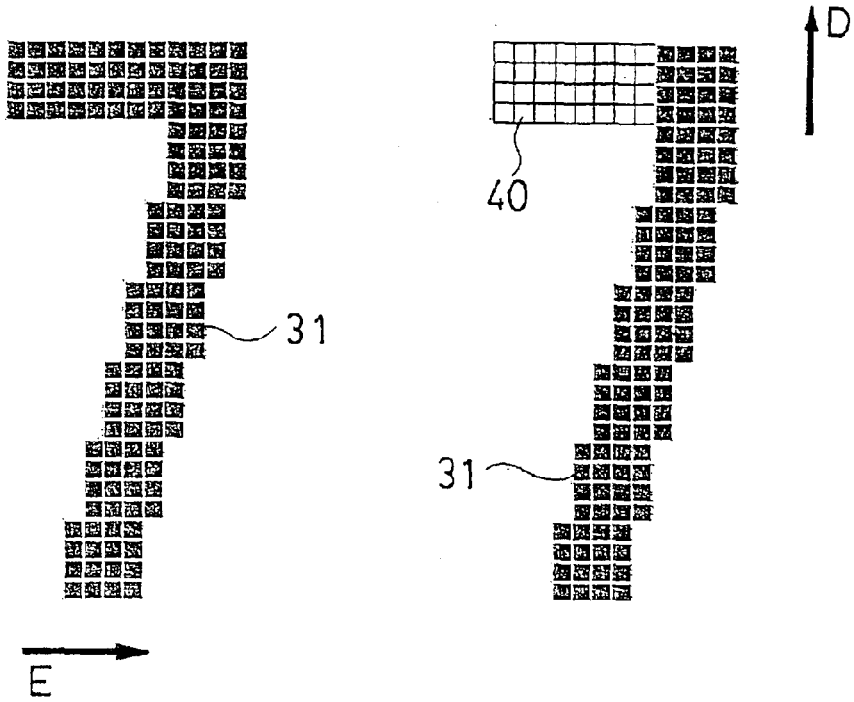
FIG. 11 is an enlarged schematic diagram showing a number printed by the barcode printer shown in FIG. 1 to FIG. 3 with its black data indicated by a black-painted small square for every one dot.
Figure 12:
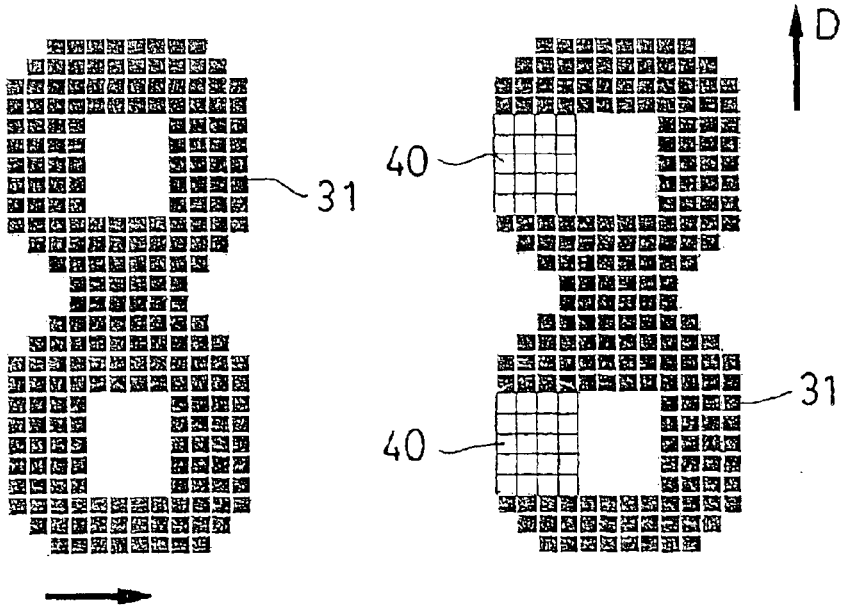
FIG. 12 is an enlarged schematic diagram, similar to FIG. 11, showing another number printed by the barcode printer shown in FIG. 1 to FIG. 3.

FIG. 11 and FIG. 12 are enlarged schematic diagrams each showing a number printed by the thermal head 9 of the barcode printer 1 with its black data indicated by a black-painted small square for every one dot. For easy recognition of the printing lack portion, every one dot is shown by an outlined small square in FIG. 11 and FIG. 12.

In FIG. 11, in which a number "77" is printed, there are 8 dots by 4 dots of printing lack dots 40 at an upper portion of a first digit "7" in a plurality of dots 31. Meanwhile in FIG. 12, in which a number "88" is printed, there are 4 dots by 5 dots of printing lack dots 40 at an upper left portion and a lower left portion of a first digit "8."

Because of the printing lacks, "77" in FIG. 11 is easily misidentified as "71" and "88" in FIG. 12 is easily misidentified as "83."

Such numbers and letters are also resolved into a plurality of tiers in the sub-scan direction (for example, resolved into tiers of four dots each in the sub-scan direction), and a plurality of scan lines are read for each of the tiers so that the verification section controller 64 compares the scan data with the printing data to judge whether it is good or no good, as in the case of the mark in the above-described two-dimensional code.

In this event, it is also adoptable to divide a number or letter into a region (tier) which is easily misidentified as described above and a region which is hardly misidentified, and to vary, for each region, the criteria of the printing data to be stored in the printing data storage means 53 in advance.

As for the region that is hardly misidentified, it is also adoptable that, for example, when all of the scan lines are judged to be NG as described above, the tier is judged to be no good, while as for the region that is easily misidentified, the tier is judged to be no good when some several lines among the scan lines are judged to be NG.

Further, it is also adoptable that as for the region that is hardly misidentified, when the tiers judged to be no good are in succession, the mark is judged to be no good as described above, but as for the region that is easily misidentified, the mark is judged to be no good only when the tier is judged to be no good.

In this case, it is possible to judge the mark to be no good when a printing lack occurs at the region that is easily misidentified and judge the mark to be good when the same size printing lack occurs at the region hardly misidentified. The criteria, however, are not limited to the above, but any criteria are acceptable as long as they are suitable for the kind and size of letters and numbers.

Subsequently, a mark printing control method of the barcode printer 1 according to the invention is described.

In the thermal head 9 shown in FIG. 2, each of the heat generating elements generates heat in accordance with energy applied thereto to fuse the ink of the thermal transfer ribbon 43. Therefore, each heat generating element generates in a heating value suitable for fusing the ink of the thermal transfer ribbon 43 if the energy applied to each heat generating element of the thermal head 9 is appropriate, and therefore the size of one dot of image of the ink to be transferred to the label 13 (hereinafter referred to as a "transferred ink image") becomes almost equal to the dimensions of the pixel defined by the dot resolution depending on the density of arrangement of heat generating elements of the thermal head.

Figure 13:
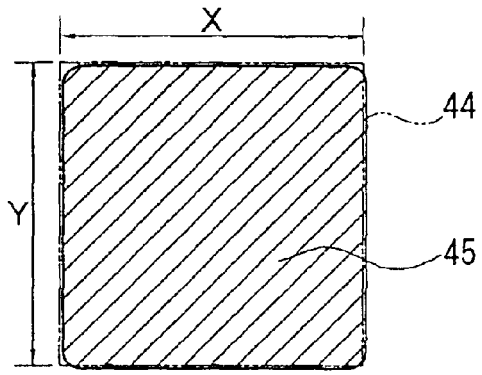
FIG. 13 is a schematic diagram showing the size of one dot of image of ink to be transferred to a label with respect to the dimensions of a pixel of a thermal head when the energy applied to the thermal head is appropriate.

FIG. 13 is a schematic diagram showing the size of the transferred ink image with respect to the dimensions of the pixel of the thermal head (corresponding to the size of one heat generating element) when the energy applied to each heat generating element of the thermal head is appropriate.

Note that a pixel 44 of the thermal head 9 is shown by a two-dotted chain line, and the dimension thereof in the main scan direction is defined as X and the dimension thereof in the sub-scan direction is defined as Y Further, for easy understanding, the position of the pixel 44 is shown displaced from the position of a transferred ink image 45 in FIG. 13.

When the energy applied to the thermal head is appropriate, the size of the transferred ink image 45 is almost equal to the dimensions of the pixel 44 as shown in FIG. 13. In this case, the width dimensions of black data continuing in the main scan direction and the sub-scan direction of the image of a printed mark almost coincide with the width dimensions of black data of the printing data.

Figure 14:
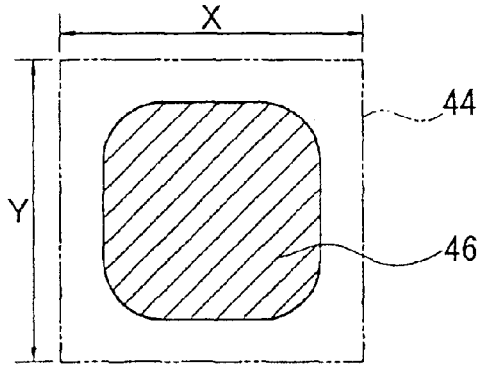
FIG. 14 is a schematic diagram similar to FIG. 13 when the energy applied to the thermal head is insufficient.

On the other hand, when the energy applied to the thermal head 9 is less than the appropriate value, the heat generating value of the heating element of the thermal head 9 is small, and therefore the size of a transferred ink image 46 is smaller than the dimensions of the pixel 44 both in the main scan direction and the sub-scan direction as shown in FIG. 14. In this case, the width dimensions of black data of the image of the printed mark become smaller than the width dimensions of black data of the printing data.

Figure 15:
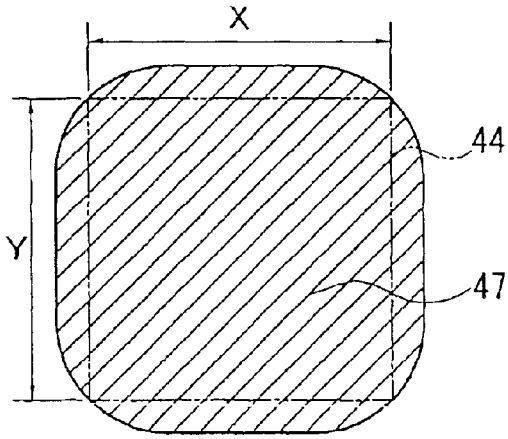
FIG. 15 is a schematic diagram similar to FIG. 13 and FIG. 14 when the energy applied to the thermal head is excessive.

Alternatively, when the energy applied to the thermal head 9 is greater than the appropriate value, the heat generating value of the heating element of the thermal head 9 is great, and therefore the size of a transferred ink image 47 is greater than the dimensions of the pixel 44 both in the main scan direction and the sub-scan direction as shown in FIG. 15. In this case, the width dimensions of black data of the image of the printed mark become greater than the width dimensions of black data of the printing data.

However, the verification section controller 64 of the control section 3 compares, as described above, the width dimension of the black data of an image of a printed mark in the main scan direction with the width dimension of the black data of the printing data corresponding thereto in the main scan direction, and judges that the printed mark is no good when the difference therebetween (the width dimension of the black data of the image of the printed mark minus the width dimension of the black data of the printing data) exceeds the black data width dimension allowable range included in the printing data.

In this event, when the average of differences in width dimension between the compared black data is negative (when the width dimension of the black data of the image of the printing mark is smaller than the width dimension of the black data of the printing data), the verification section controller 64 directs the thermal head controller 61 to increase the energy applied to the thermal head 9 so as to raise the heating value of the heat generating element of the thermal head 9 (shown by an arrow S17 in FIG. 1).

Contrary, when the average of differences in width dimension between the compared black data is positive (when the width dimension of the black data of the image of the printed mark is greater than the width dimension of the black data of the printing data), the verification section controller 64 directs the thermal head controller 61 to decrease the energy applied to the thermal head 9 so as to lower the heating value of each heat generating element of the thermal head 9.

Control of the mark printing by the barcode printer by such a method allows the thermal head to generate heat in an appropriate value at all times, thus permitting the size of the transferred ink image to substantially coincide with the pixel dimensions of the thermal head.

It should be noted that the size of the transferred ink image to be controlled by this mark printing control method is not limited to the size which is substantially coincides with the pixel dimensions of the thermal head. If the width dimensions of the black data of the printing data stored in the printing data storage means 53 are set to predetermined optimal dimensions in accordance with the material of the label and the kind of the thermal transfer ribbon 43 in advance, the size of the transferred ink image can be controlled to the predetermined dimensions.

Incidentally, the barcode printer 1 described with FIG. 1 and FIG. 2 uses the thermal head 9 having a resolution of 300 dpi. However, when a two-dimensional symbol with a higher density is required in the future, the resolution of the thermal head needs to be increased to 600 dpi and 800 dpi. When the resolution of the thermal head is increased, the dimensions of the pixel defined by the dot resolution of the thermal head becomes smaller, and therefore the size of one dot of image of the ink (a transferred ink image) to be transferred to the label also becomes smaller. Accordingly, the alignment of the dot line of the printed mark with the scan line read by the scanner 2 needs to be conducted with a higher accuracy.

Figure 16:
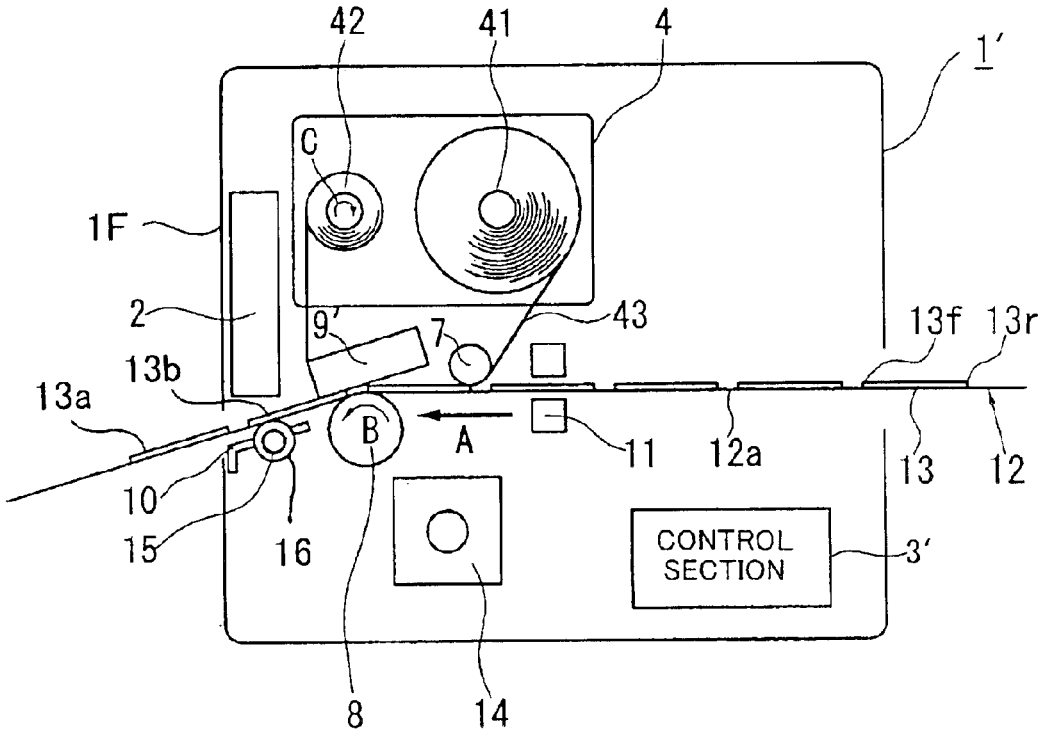
FIG. 16 is a side view of a principal portion, similar to FIG. 2, showing a barcode printer of another embodiment of the mark printing/verifying device according to the invention.
Figure 17:
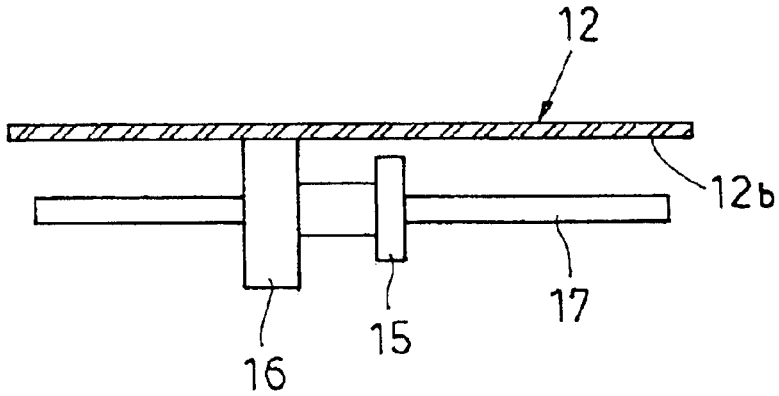
FIG. 17 is a front view showing placement of a sheet conveyance amount detecting encoder and a sheet rear face contact roller shown in FIG. 16.
Figure 18:
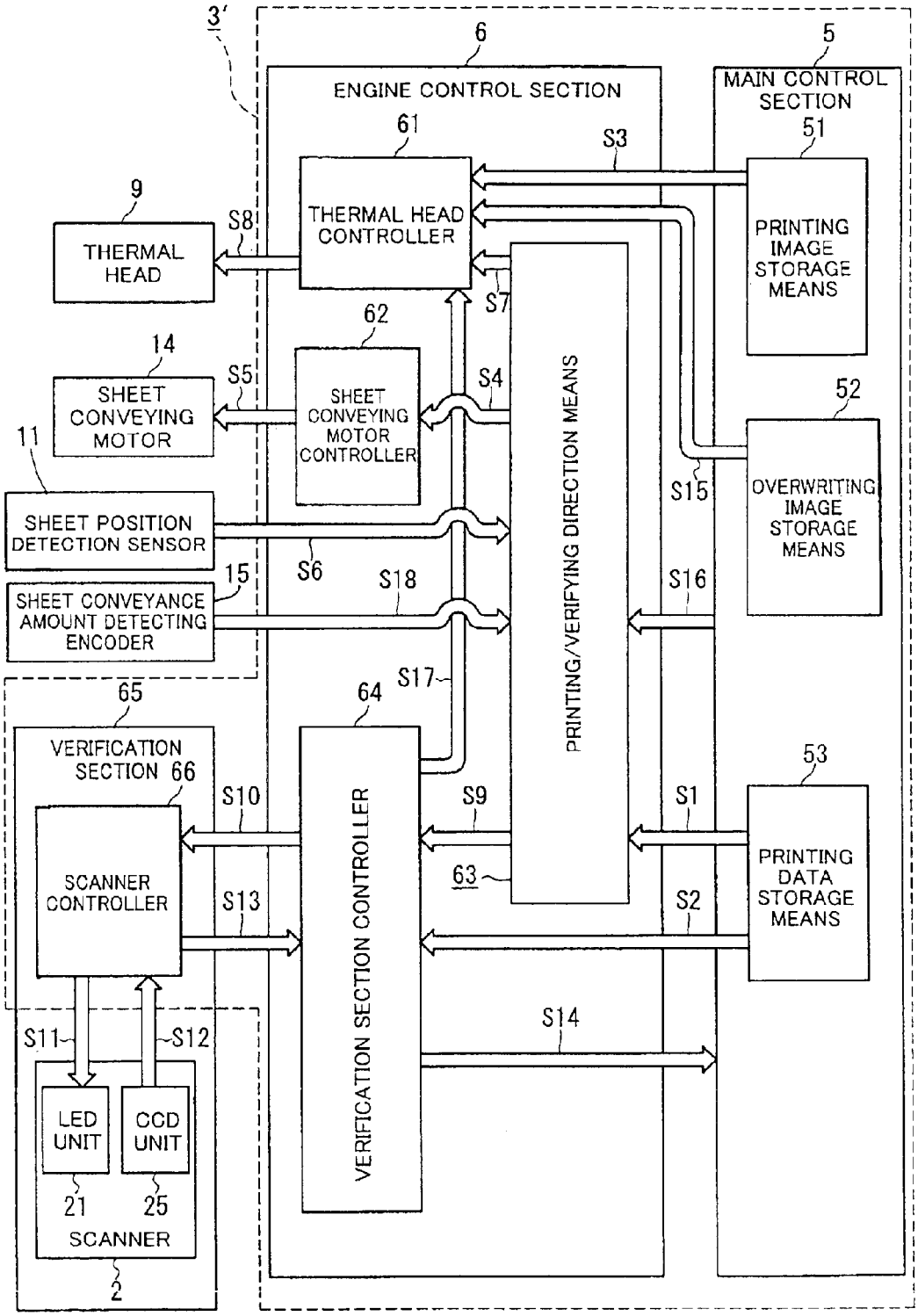
FIG. 18 is a block diagram showing the function of a control section of the barcode printer shown in FIG. 16.

FIG. 16, showing another embodiment of the mark printing/verifying device according to the invention, is a side view, similar to FIG. 2, of a principal portion of a barcode printer provided with a thermal head having a high resolution. FIG. 17 is a front view showing placement of its sheet conveyance amount detecting encoder and a sheet rear face contact roller. Further, FIG. 18 is a block diagram showing the function of a control section of the barcode printer shown in FIG. 16. Incidentally, portions in FIG. 16 and FIG. 18 the same as those in FIG. 1 and FIG. 2 are assigned the same reference numbers to omit the descriptions.

A barcode printer 1' in FIG. 16 includes a sheet conveyance amount detecting encoder 15 for detecting the conveyance amount of a sheet and a sheet rear face contact roller 16, placed on a guide plate 10 as also shown in FIG. 17.

The sheet rear face contact roller 16 and sheet conveyance amount detecting encoder 15 are attached to an encoder shaft 17 to be rotatable with rotation of the encoder rotation of the shaft 17. The sheet rear face contact roller 16 is in contact with a rear face (sheet rear face) 12*b* of the sheet 12 being a non-printing face and rotated in accordance with the movement amount of the sheet 12. This sheet rear face contact roller 16 is connected to the sheet conveyance amount detecting encoder 15 so as to rotate in synchronization therewith, so that when the sheet rear face contact roller 16 is rotated in accordance with the movement amount of the sheet 12, the movement amount is detected by the sheet conveyance amount detecting encoder 15.

As shown in FIG. 18, the detection result of the sheet conveyance amount detecting encoder 15 is sent to a printing/verifying direction means 63 similarly to the above-described detection result of the sheet position detection sensor 11 (S18).

Then, the printing/verifying direction means 63 determines the position and the movement amount of the label 13 based on the detection results of both the sheet position detection sensor 11 and the sheet conveyance amount detecting encoder 15. Then, the printing/verifying direction means 63 allows, through the verification section controller 64, the scanner controller 66 to control the scanner 2 being an image reader so as to read the image on the label 13. In other words, every time a label 13 is moved from a reference position by a predetermined amount, the scanner 2 is allowed to read the image (image of printed mark) on the label.

It should be noted that the case has been described in which a mark is printed on the label 13 being a release sheet attached onto the mount 12*a* of the sheet 12 and verified in the above-described barcode printer. The item to be printed, however, is not limited to the aforementioned label, but the same effects can be obtained even when marks are printed on various kinds of sheets (including, for example, a long sheet, a cut sheet, a film sheet, a pouched sheet, a cardboard for forming a paper box) according to usage of the marks and verified.

As has been described, in the mark printing/verifying device according to the invention, since dot lines which have been set in advance of a printed mark can be read one by one by a scanner and judged, even a two-dimensional code having a high information density and a very small symbol size can be verified without use of a large capacity of memory and with no decrease in throughput.

Further, an overwriting image can be printed over a printed mark having a problem in read characteristics caused by occurrence of a printing defect to disable the use, thereby preventing the printed mark having a problem in read characteristics from being mixed into normal marks and from being unintentionally used.

Besides, the overwriting image data stored in the overwriting image storage means 52 may be the same image data as a mark having a problem in read characteristics which has been already printed. Then, the printed mark having a problem in read characteristics is returned to the printing position by the thermal head and the overwriting image is reprinted thereover, which makes it possible to fill a lacked printing defect due to paper powder or the like attached thereto is filled, thereby printing, for reproduction, the printed mark having a problem in read characteristics.

Further, according to the mark printing/verifying method of the invention by the mark printing/verifying device, the scan line position of the scanner can be corrected with respect to the position of the dot line of the printed mark, thus preventing a normal mark from being judged to be no good because of a read error of the scanner.

Further, the criteria of good or no good can be changed in accordance with letters and marks, thus preventing a letter having a problem in visual recognition from being judged to be good, or a mark having a printing defect which can be encoded by the error correcting function of a mark from being judged to be no good.

Furthermore, according to the mark printing control method of the invention by the aforementioned mark printing/verifying device, the heating value of the thermal head can be controlled to an appropriate value without use of a temperature sensor or the like so as to make the size of one dot of image of a printed mark to a predetermined size with respect to the dimensions of a pixel which are defined by the dot resolution of the thermal head.

What is claimed is:

1. A mark printing/verifying device, comprising a thermal head for printing a mark on a sheet, a sheet conveying motor for conveying the sheet, a sheet position detector for detecting a position of the sheet, and an image reader, located downstream from said thermal head in a sheet conveying direction, for reading an image of a printed mark being the mark printed by said thermal head, and a control section for controlling them, said control section, comprising:

a printing image storage means for storing image data indicating a mark in unit of a dot resolution in a main scan direction being a sheet width direction and a sub-scan direction being the sheet conveying direction of said thermal head;

a printing data storage means for storing printing position data and printing data of the mark;

a thermal head controller for selectively permitting heating elements of said thermal head to generate heat in accordance with the image data;

a sheet conveying motor controller for controlling said sheet conveying motor; and a printing/verifying direction means for directing said thermal head controller and sheet conveying motor controller to do printing in accordance with the sheet position detected by said sheet position detector, and directing said image reader to read the image of the printed mark based on the printing position data, and including a function of comparing the image of the printed mark read by said image reader with the printing data to judge whether the printed mark is good or no good based on predetermined criteria included in the printing data, and, when the mark is no good, performing invalid printing on a sheet printed with the mark.

2. The mark printing/verifying device according to claim 1, wherein said function of performing the invalid printing of said control section is a function of returning the sheet printed with the mark to a printing position by said thermal head, and allowing said thermal head to overprint a predetermined image thereon, in the case of no good.

3. The mark printing/verifying device according to claim 1, wherein said control section includes a function of, when performing the invalid printing, conveying the sheet to an arbitrary position, and selectively permitting the heating elements of said thermal head to generate heat in accordance with the image data based on which the mark judged to be no good has been printed so as to reprint the mark thereon.

4. The mark printing/verifying device according to claim 2, wherein said control section includes a function of, when performing the invalid printing, conveying the sheet to an arbitrary position, and selectively permitting the heating elements of said thermal head to generate heat in accordance with the image data based on which the mark judged to be no good has been printed so as to reprint the mark thereon.

5. A mark printing/verifying method by the mark printing/verifying device according to claim 1, comprising the steps of:

dividing the mark in a sub-scan direction to constitute it of a plurality of tiers having a height of integral multiples of a dot resolution in the sub-scan direction of the thermal head;

the image reader reading an image a plurality of times at predetermined intervals in the sub-scan direction for the plurality of tiers respectively;

the control section judging, every time the image reader reads the image once, whether the read image is good or no good based on a line criterion among the predetermined criteria included in the printing data, such that when the number of judgments to be no good exceeds a predetermined number, the tier is judged to be no good, and when the tier which has been judged to be no good does not satisfy a mark criterion among the predetermined criteria included in the printing data, the mark is judged to be no good.

6. A mark printing/verifying method by the mark printing/verifying device according to claim 2, comprising the steps of:

dividing the mark in a sub-scan direction to constitute it of a plurality of tiers having a height of integral multiples of a dot resolution in the sub-scan direction of the thermal head;

the image reader reading an image a plurality of times at predetermined intervals in the sub-scan direction for the plurality of tiers respectively;

the control section judging, every time the image reader reads the image once, whether the read image is good or no good based on a line criterion among the predetermined criteria included in the printing data, such that when the number of judgments to be no good exceeds a predetermined number, the tier is judged to be no good, and when the tier which has been judged to be no good does not satisfy a mark criterion among the predetermined criteria included in the printing data, the mark is judged to be no good.

7. A mark printing/verifying method by the mark printing/verifying device according to claim 3, comprising the steps of:

dividing the mark in a sub-scan direction to constitute it of a plurality of tiers having a height of integral multiples of a dot resolution in the sub-scan direction of the thermal head;

the image reader reading an image a plurality of times at predetermined intervals in the sub-scan direction for the plurality of tiers respectively;

the control section judging, every time the image reader reads the image once, whether the read image is good or no good based on a line criterion among the predetermined criteria included in the printing data, such that when the number of judgments to be no good exceeds a predetermined number, the tier is judged to be no good, and when the tier which has been judged to be no good does not satisfy a mark criterion among the predetermined criteria included in the printing data, the mark is judged to be no good.

8. A mark printing/verifying method by the mark printing/verifying device according to claim 4, comprising the steps of:

dividing the mark in a sub-scan direction to constitute it of a plurality of tiers having a height of integral multiples of a dot resolution in the sub-scan direction of the thermal head;

the image reader reading an image a plurality of times at predetermined intervals in the sub-scan direction for the plurality of tiers respectively;

the control section judging, every time the image reader reads the image once, whether the read image is good or no good based on a line criterion among the predetermined criteria included in the printing data, such that when the number of judgments to be no good exceeds a predetermined number, the tier is judged to be no good, and when the tier which has been judged to be no good does not satisfy a mark criterion among the predetermined criteria included in the printing data, the mark is judged to be no good.

9. The mark printing/verifying method according to claim 5, wherein when the control section judges that the image on a first read by the image reader in a first tier of the printed mark is no good based on the predetermined criteria included in the printing data, a read position by the image reader is corrected in the sub-scan direction by a predetermined amount based on correction judgment information.

10. The mark printing/verifying method according to claim 6, wherein when the control section judges that the image on a first read by the image reader in a first tier of the printed mark is no good based on the predetermined criteria included in the printing data, a read position by the image reader is corrected in the sub-scan direction by a predetermined amount based on correction judgment information.

11. The mark printing/verifying method according to claim 7, wherein when the control section judges that the image on a first read by the image reader in a first tier of the printed mark is no good based on the predetermined criteria included in the printing data, a read position by the image reader is corrected in the sub-scan direction by a predetermined amount based on correction judgment information.

12. The mark printing/verifying method according to claim 8, wherein when the control section judges that the image on a first read by the image reader in a first tier of the printed mark is no good based on the predetermined criteria included in the printing data, a read position by the image reader is corrected in the sub-scan direction by a predetermined amount based on correction judgment information.

13. The mark printing/verifying method according to claim 5, wherein the position and a movement amount of the sheet are detected, so that every time the sheet is moved from a reference position by a predetermined amount, the image reader reads the image on the sheet.

14. The mark printing/verifying method according to claim 6, wherein the position and a movement amount of the sheet are detected, so that every time the sheet is moved from a reference position by a predetermined amount, the image reader reads the image on the sheet.

15. The mark printing/verifying method according to claim 7, wherein the position and a movement amount of the sheet are detected, so that every time the sheet is moved from a reference position by a predetermined amount, the image reader reads the image on the sheet.

16. The mark printing/verifying method according to claim 8, wherein the position and a movement amount of the sheet are detected, so that every time the sheet is moved from a reference position by a predetermined amount, the image reader reads the image on the sheet.

17. A mark printing control method by the mark printing/verifying device according to claim 1, comprising the steps of:

the control section comparing a width in the main scan direction of the image of the printed mark read by the image reader with a width in the main scan direction of the printing data; and the thermal head controller operating to lower a heating value of the thermal head when an average of values obtained by subtracting a width dimension in the main scan direction of the printing data from a width dimension in the main scan direction of the image of the printed mark is positive, and raise the heating value of the thermal head when the average is negative.

18. A mark printing control method by the mark printing/verifying device according to claim 2, comprising the steps of:

the control section comparing a width in the main scan direction of the image of the printed mark read by the image reader with a width in the main scan direction of the printing data; and the thermal head controller operating to lower a heating value of the thermal head when an average of values obtained by subtracting a width dimension in the main scan direction of the printing data from a width dimension in the main scan direction of the image of the printed mark is positive, and raise the heating value of the thermal head when the average is negative.

19. A mark printing control method by the mark printing/verifying device according to claim 3, comprising the steps of:

the control section comparing a width in the main scan direction of the image of the printed mark read by the image reader with a width in the main scan direction of the printing data; and the thermal head controller operating to lower a heating value of the thermal head when an average of values obtained by subtracting a width dimension in the main scan direction of the printing data from a width dimension in the main scan direction of the image of the printed mark is positive, and raise the heating value of the thermal head when the average is negative.

20. A mark printing control method by the mark printing/verifying device according to claim 4, comprising the steps of:

the control section comparing a width in the main scan direction of the image of the printed mark read by the image reader with a width in the main scan direction of the printing data; and the thermal head controller operating to lower a heating value of the thermal head when an average of values obtained by subtracting a width dimension in the main scan direction of the printing data from a width dimension in the main scan direction of the image of the printed mark is positive, and raise the heating value of the thermal head when the average is negative.

* * * * *